US005937673A

United States Patent [19]

Shima

[11] Patent Number: 5,937,673

[45] Date of Patent: Aug. 17, 1999

[54] COMPOUND NEEDLE OF A FLAT KNITTING MACHINE

[75] Inventor: Masahiro Shima, Wakayama, Japan

[73] Assignee: Shima Seiki Manufacturing, Ltd., Wakayama, Japan

[21] Appl. No.: 09/064,841

[22] Filed: Apr. 23, 1998

[30] Foreign Application Priority Data

May 1, 1997 [JP] Japan ..... 9-113994
Sep. 10, 1997 [JP] Japan ..... 9-245741

[51] Int. Cl.[6] ..... D04B 35/06

[52] U.S. Cl. ..... 66/120; 66/123

[58] Field of Search ..... 66/116, 120, 123, 66/13, 62, 75.1

[56] References Cited

U.S. PATENT DOCUMENTS

| | | | |
|---|---|---|---|
| 4,474,037 | 10/1984 | Kühnert | 66/78 |
| 4,637,228 | 1/1987 | Shima | 66/120 |
| 4,637,277 | 1/1987 | Shima | 66/120 |
| 5,035,124 | 7/1991 | Tibbals, Jr. | 66/230 |
| 5,186,026 | 2/1993 | Teufel | 66/123 |
| 5,216,901 | 6/1993 | Okada | 66/120 |

FOREIGN PATENT DOCUMENTS

| | | | |
|---|---|---|---|
| 2292953 | 8/1995 | United Kingdom | 66/120 |

*Primary Examiner*—John J. Calvert
*Assistant Examiner*—Larry D. Worrell, Jr.
*Attorney, Agent, or Firm*—Nikaido, Marmelstein, Murray & Oram LLP

[57] ABSTRACT

A needle proper is formed to have a hook at the tip, a slider groove formation part, a needle proper center that follows the slider groove formation part, and a rear that allows a control butt to sink into the needle groove. A slider comprises a first slider and a second slider. The first slider is formed by overlapping two thin plates, and tongues are formed on the tips of these plates, and the rear parts of the plates are exposed in the needle proper center, and these exposed portions are coupled with an under arm of the second slider. The second slider is formed to have a head that contacts the upper edge of the slider groove formation part to support the slider, a rear part that allows a control butt, that is protrusively formed on a part extending backward beyond the needle proper center, to sink into the needle groove, and an under arm in the middle for coupling the first slider.

8 Claims, 14 Drawing Sheets

FIG. 4-a
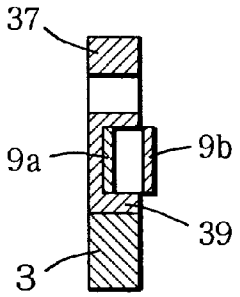
FIG. 4-b
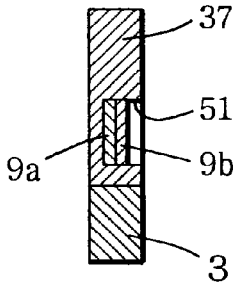
FIG. 4-c
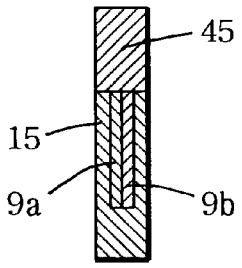

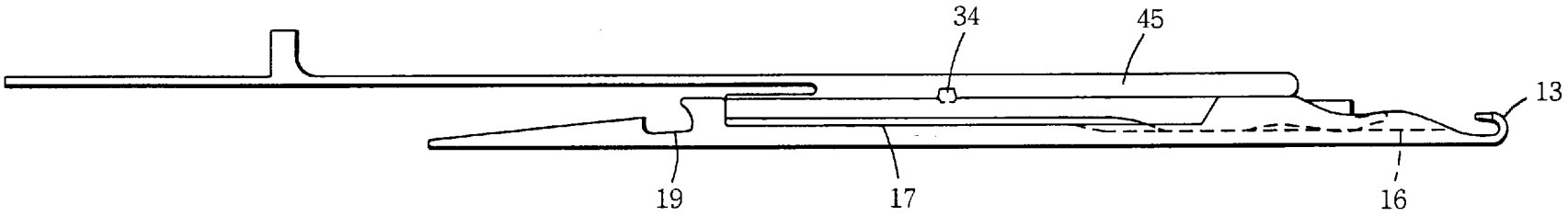
FIG. 5-a
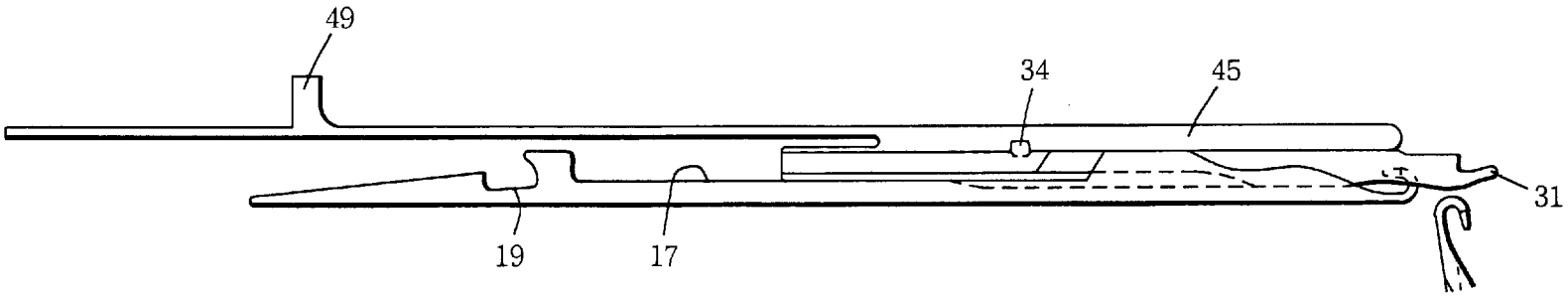
FIG. 5-b

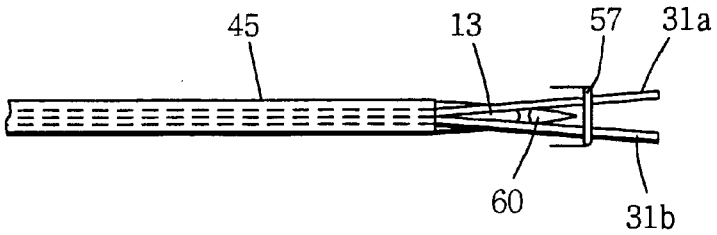
FIG. 6-b
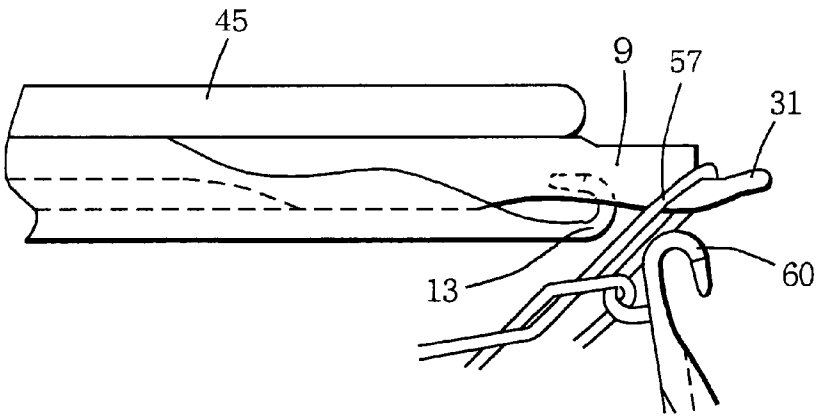
FIG. 6-a

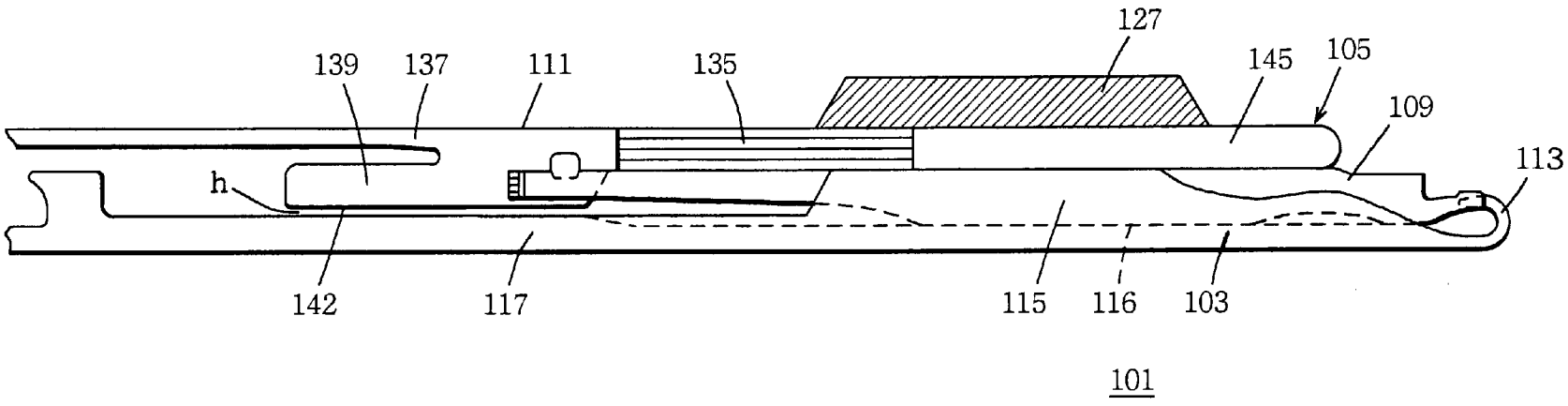
FIG. 8-a
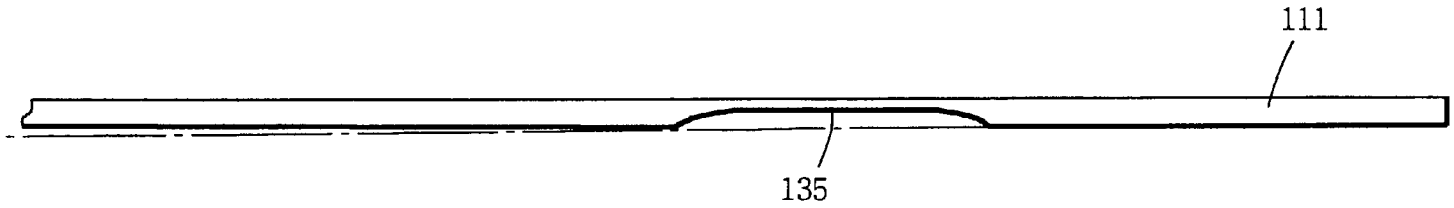
FIG. 8-b

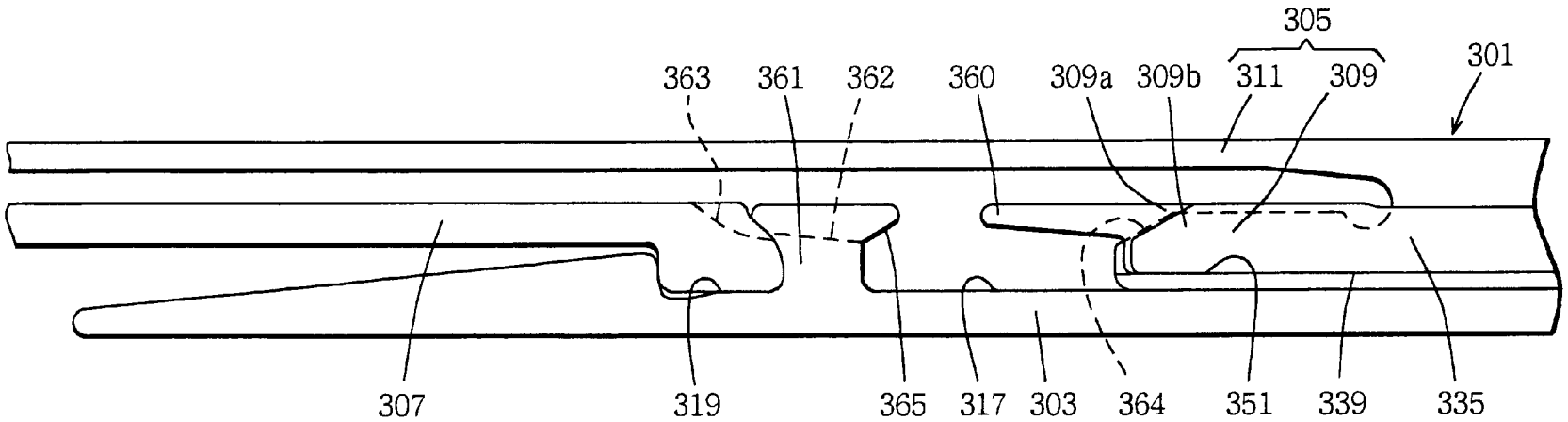
FIG. 11-a
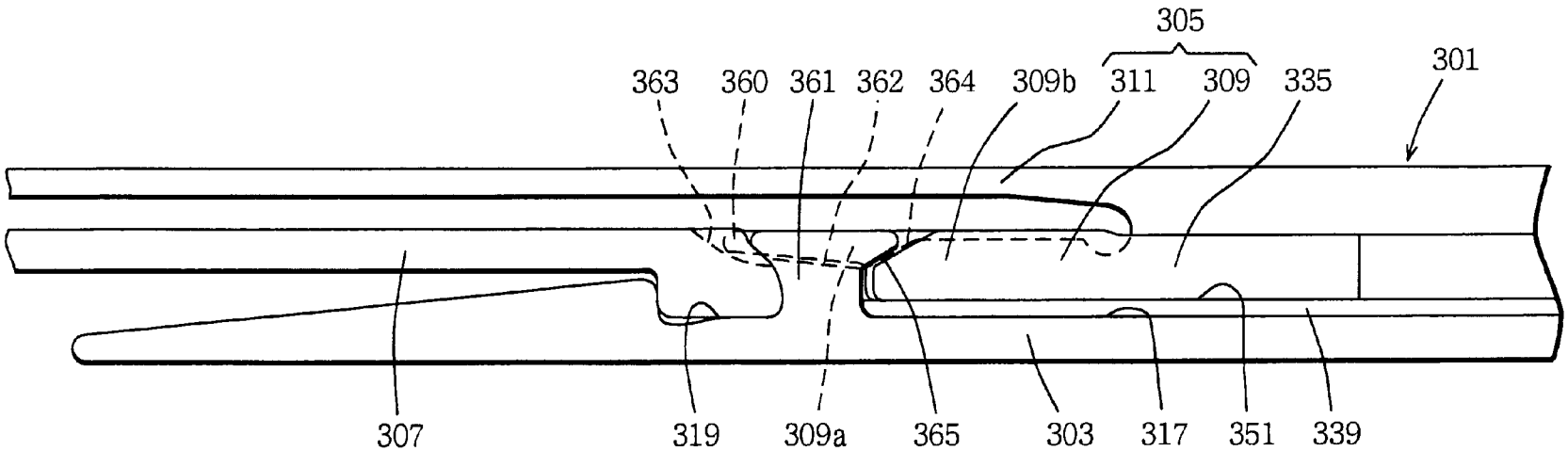
FIG. 11-b

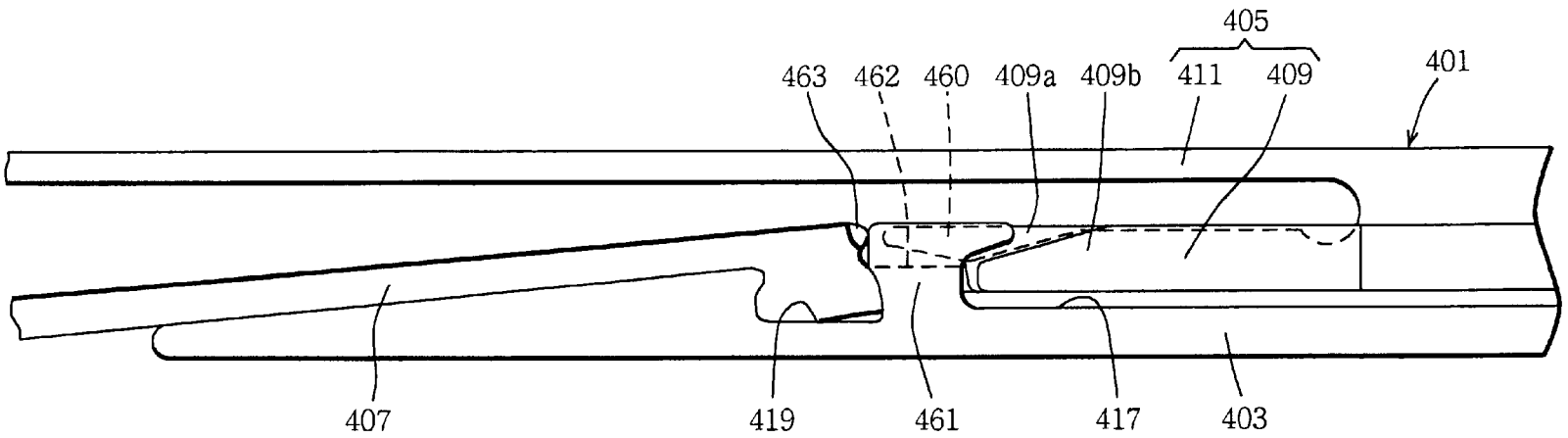
FIG. 12-a
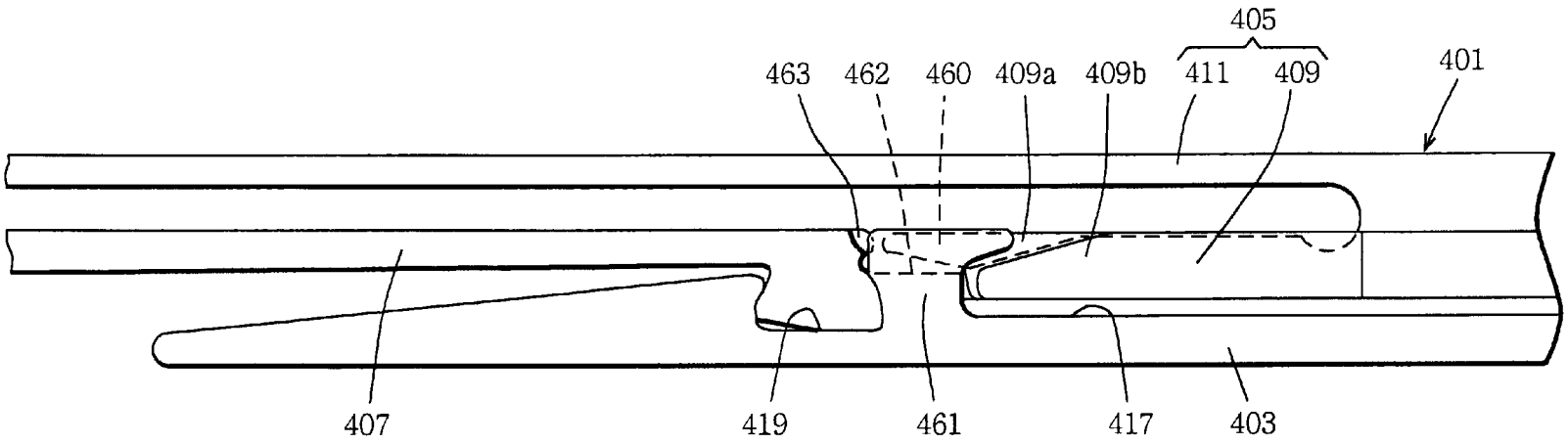
FIG. 12-b

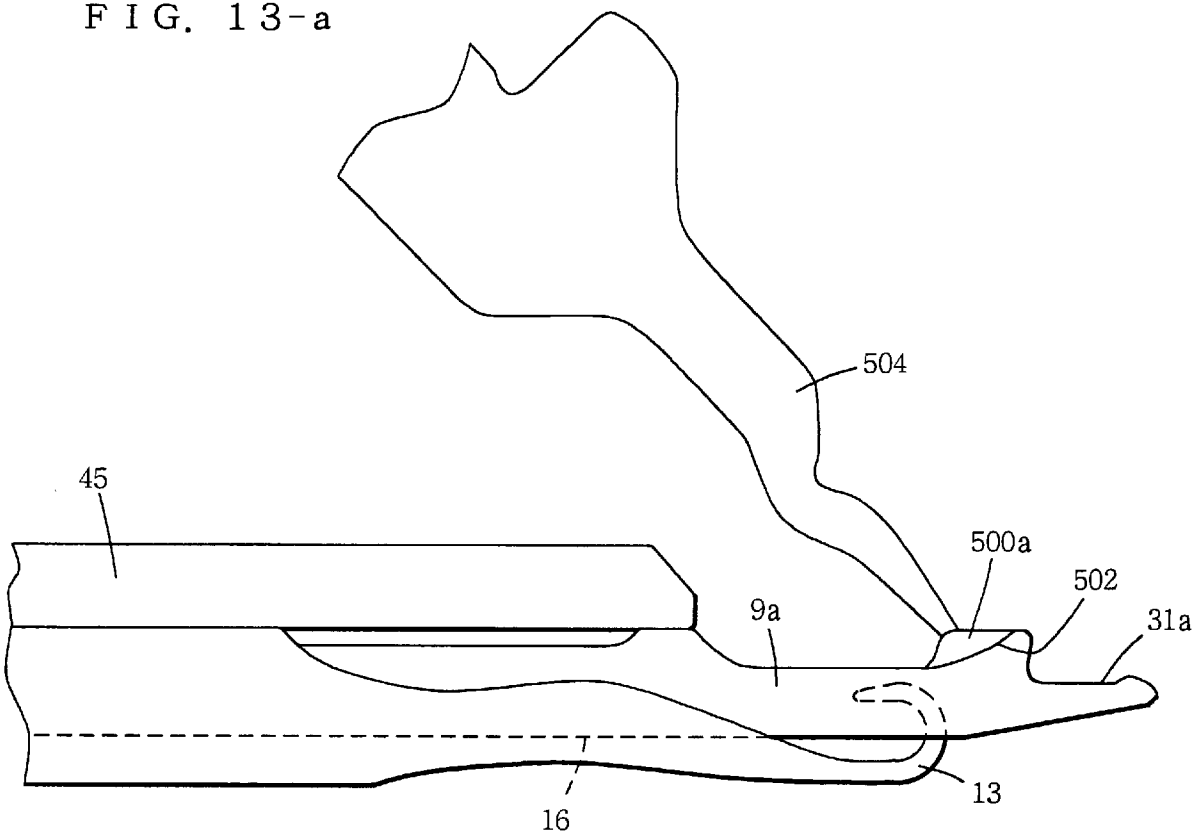
FIG. 13-a
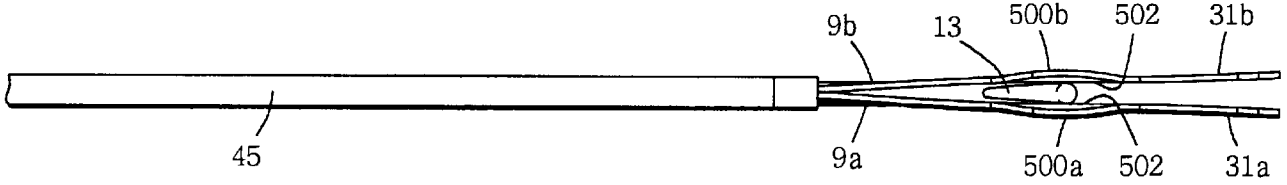
FIG. 13-b

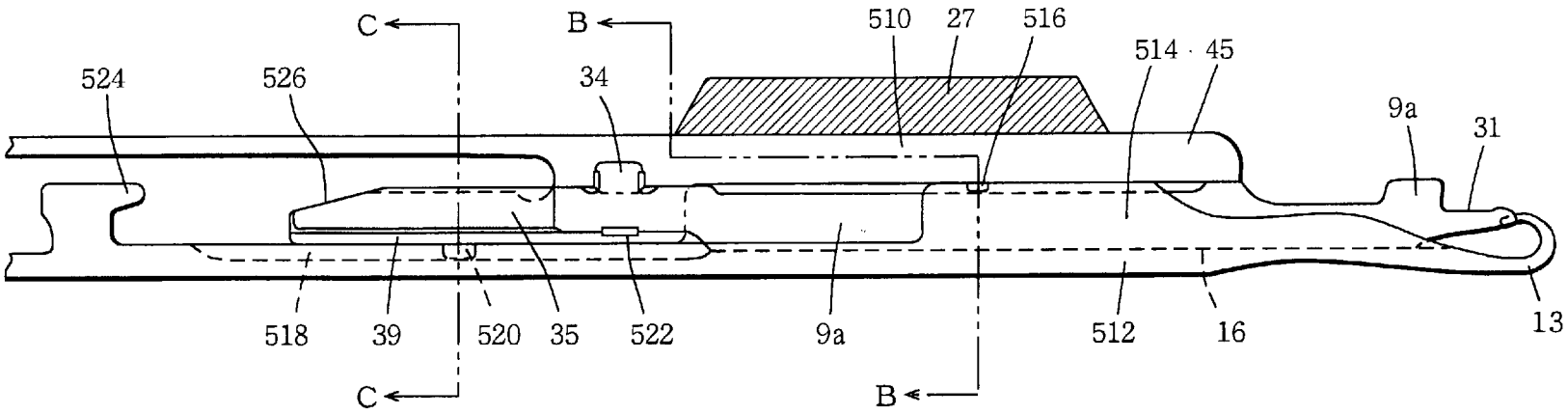
FIG. 14-a
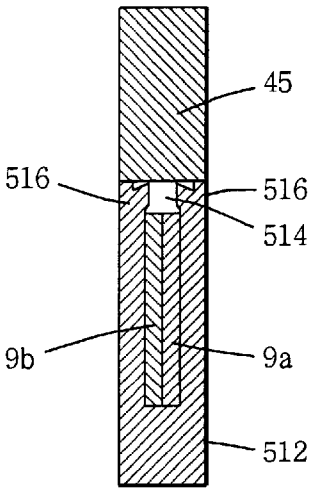
FIG. 14-b
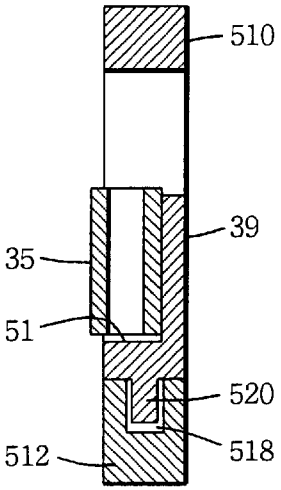
FIG. 14-c

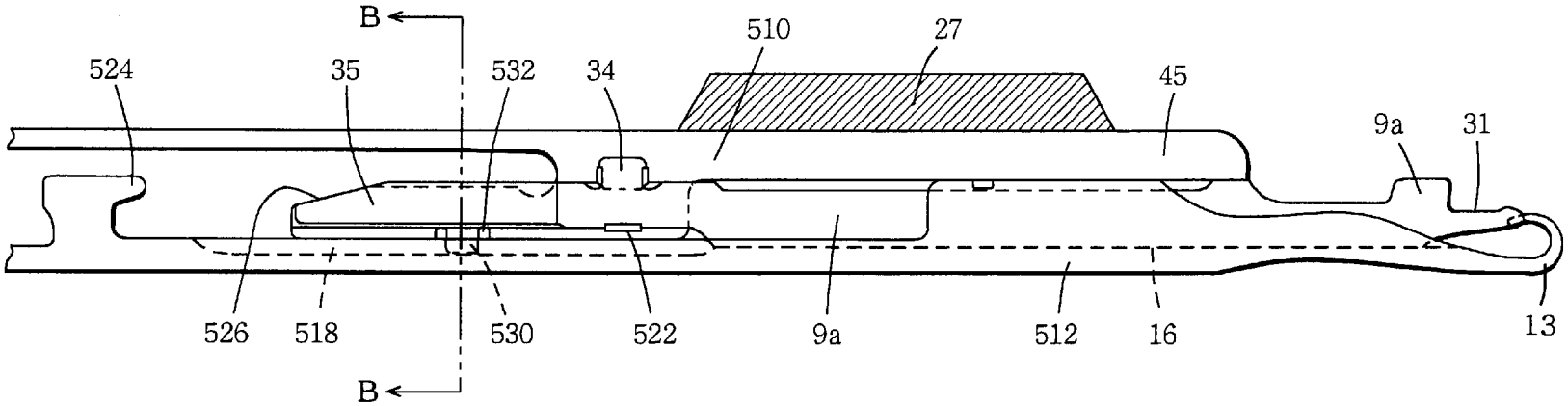
FIG. 15-a
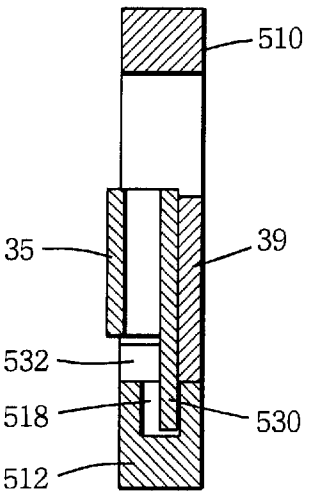
FIG. 15-b

COMPOUND NEEDLE OF A FLAT KNITTING MACHINE

FIELD OF THE INVENTION

The present invention relates to a compound needle for a flat knitting machine, wherein a slider thereof is provided with a transferring function.

PRIOR ART

In the present specification, when actions and various parts of the needle proper and the slider that constitute the compound needle are described, the longitudinal direction of the compound needle contained in a needle groove is defined as the front-rear direction, the hook side is defined as the front side and the other the rear side, and the direction perpendicular to the surface of the needle bed is defined as the vertical direction or high-low direction.

A compound needle wherein the slider and the needle proper are moved relative to each other to open and close the hook can reduce the stroke of the forward and backward movements of the needle to about one half of that of a latch needle. Hence the adoption of a compound needle to a flat knitting machine can reduce the size of the flat knitting machine, and this, in turn, will improve the productivity. A compound needle having this kind of transferring function is described in Japanese Patent Sho62-19535. The needle proper of this compound needle has a hook at the top end thereof, and is provided, in the rear of the hook, with a slider groove that receives a slider to support the slider so that the slider can be moved forward and backward in the sliding direction of the needle proper. A portion of the needle proper to the rear of part that slidingly contacts the bottom of the needle groove is formed to extend upward on a slant in the needle groove so that a control butt that is provided in the tail of the needle proper protrudes out of the needle bed. The slider comprises thin plate parts of the same configuration, and is contained in a slider groove formed in the needle proper. A tongue that can be moved forward beyond the hook of the needle proper is formed at the top end of the slider, and a control butt that controls the forward and backward movements of the slider is provided at the tail end of the slider, the control butt protruding out of the needle groove.

In the above-mentioned compound needle, the control butt of the slider is arranged to constantly protrude out of the top surface of the needle bed. This requires that, for example, when the amounts of forward and backward movements of the slider are to be selectively controlled for knitting, tucking or transferring, a cam that is provided on a carriage to guide the slider must be a movable one that can be protruded and retracted. As a result, the cam mechanism for controlling the slider is complicated.

SUMMARY OF THE INVENTION

One objective of the present invention is, in relation to a compound needle of a flat knitting machine, to provide a compound needle of the above-mentioned kind, wherein the control butt that controls the forward and backward movements of the slider is sinkable into the needle groove and the slider can be securely supported in the needle groove, and to simplify, by this, the configuration of the cam mechanism that controls the slider.

Another objective of the present invention is to provide a compound needle of the above-mentioned kind, wherein a sliding resistance against the needle groove is given to the slider to restrain inadvertent movement of the slider, and this sliding resistance is arranged not to have adverse effects on the sinking and rising of the control butt of the slider.

One other objective of the present invention is to provide a compound needle of the above-mentioned kind that allows easy replacement of the compound needle set in the groove needle.

The compound needle for a flat knitting machine according to the present invention is a compound needle wherein the compound needle is contained in a needle groove formed in a needle bed of a flat knitting machine, the compound needle comprises a needle proper having a hook at the top end thereof and a slider, a movement of the needle proper and the slider relative to each other makes a tongue provided on the top end of the slider open or close the hook, and the tongue can be moved beyond the hook.

The compound needle of the present invention comprises certain specific features.

The said slider comprises a first slider part and a second slider part.

In the back of the hook 13 formed at the top end of the needle proper, the needle proper is provided with a slider groove formation part for forming a slider groove to contain the first slider part, the upper edge of the slider groove formation part being made to contact the second slider part.

In the back of the slider groove formation part, a needle proper center portion 17 is formed by indenting the upper part of the needle proper.

A control butt is provided on the upper edge of the needle proper extending backward from the needle proper center portion, and an elastic needle proper rear leg, that allows the control butt to sink into the needle groove, is formed in the needle proper.

The first slider part comprises two thin plates 9*a*, 9*b* that are contained in the slider groove formed in the needle proper, and tongues 31*a*, 31*b* are formed at the top ends of the thin plates, and the rear of the first slider part is exposed above the needle proper center.

The second slider part is formed to have a thickness substantially same to that of the needle proper.

The second slider part is provided with certain specific structures which include:

- a head part 45 that extends forward above the first slider part, the lower edge thereof contacting the upper edge of the slider groove formation part, and that supports the upper edge of the first slider part,
- an elastic slider rear part that extends backward beyond the needle proper center portion, has a slider control butt at the upper edge, and allows the slider control butt to sink into the needle groove, and
- an under arm 39 that is between the elastic slider rear and the head part, extends over the needle proper center portion to connect the exposed portion of the first slider part.

A sliding-resistance-giving part, that makes the slider slide against the needle groove to use that sliding resistance is formed on the slider for preventing the slider from following the motion of the needle proper so that the slider and the needle proper move independently.

Preferably, the sliding-resistance-giving part is formed ahead of the control butt of the slider.

Preferably, the lower edge of the under arm is made to contact the upper edge of the needle proper center portion so that the slider is supported by the needle proper center portion.

Preferably, behind the tongues, the two thin plates are spread to both sides to form an opening.

Preferably, a guide groove is made in the needle proper center portion to oppose to the under arm.

Furthermore, preferably, the first slider part or the second slider part is provided, at the position of the under arm, with a protrusion, and the protrusion is contained in the guide groove.

Preferably, the upper parts of the slider groove formation part are at least partially bent inward, for example, the upper edges of the slider groove or protrusions provided on the slider groove are bent inward, to prevent the first slider part from coming out of the slider groove.

And preferably, in the rear of the under arm, the slider and a protrusion provided on the hook member are made engaged.

As the compound needle of the present invention is contained in the needle groove, with the upper edge of the slider groove formation part and the lower edge of the second slider head being in contact with each other, the needle proper and the slider mutually control their vertical positions in the needle groove. As a result, the needle proper and the slider are supported reliably. Moreover, at the time of transfer, when the hook of a receiving needle enters a stitch loop being held by tongues of the first slider part of the transferring needle, the tongues of the transferring needle will be pushed up by the receiving needle. However, the first slider part, being supported by the head of the second slider part, will not be lifted up. Further, when the control butt of the slider is made to sink into the needle groove, a force will work to lift up the slider head, with the under arm serving as the fulcrum. This upward force, however, is balanced by a force between the head of the second slider part and the metal plate of the needle bed, hence no load is exerted to the first slider part.

The sliding-resistance-giving part of the slider is formed ahead of the control butt of the slider. As the sliding-resistance-giving part of the slider is pressed against the side wall of the needle groove, the slider will not be moved inadvertently when the needle proper is moved forward or backward. When this sliding-resistance-giving part is formed ahead of and away from the control butt of the slider (which is subjected to rising/sinking control), rising and sinking of the control butt of the slider can be made quickly.

The lower edge of the under arm formed on the second slider part is made to contact the upper edge of the needle proper center portion formed in the needle proper so that the slider is supported by the needle proper center portion. With this arrangement, as the under arm as well as the head are supported by the needle proper, the slider is supported more reliably.

As the compound needle of the present invention has the above-mentioned configuration, the control butt of the slider is sinkable into the needle groove, and the slider is supported securely in the needle groove. As a result, the compound needle of the present invention can reliably perform transfer and knitting. Moreover, a slider control cam of a fixed type in place of that of a movable type can be used to simplify the cam mechanism.

As the sliding-resistance-giving part of the slider is arranged as described above, the slider is prevented to be moved inadvertently with the movement of the needle proper, and adverse effects on the rising and sinking of the control butt are minimized.

When an opening is made by expanding or spreading the portions at the back of the tongues of the first slider part to both sides, a transfer jack, etc. can be easily inserted through the opening into the first slider part. As a result, transfer can be made more easily.

When a guide groove is made in the needle proper center portion to guide the under arm of the second slider part or the exposed portion of the first slider part of that part, and a portion ahead of the exposed portion of the first slider part, etc., the slider can be prevented from coming off the needle proper sideways. In particular, when a protrusion is provided on the slider and this protrusion is guided by the guide groove, the production is easier relative to the case of containing the entire length of the under arm in the guide groove, and the protrusion can be with higher precision.

When an upper portion of the slider groove formation part is bent inward at least partially, the first slider part will be prevented from coming off the needle proper upward and from vibrating. When the tail of the under arm or the tail of the exposed portion of the first slider part is engaged with a protrusion of the needle proper and such a tail is engaged with the protrusion in the compound needle prior to mounting it on the needle bed, the tail can be prevented from coming off upward. With this arrangement, the compound needle of the present invention allows the needle proper and the slider to be integrated together, ensuring easy replacement of the needle.

BRIEF DESCRIPTION OF THE DRAWINGS

FIGS. 4-*a* to 4-*c* are cross-sectional views of the compound needle of FIG. 2. FIG. 4-*a* is a sectional view along the line I—I of FIG. 2, FIG. 4-*b* is a sectional view along the line II—II, and FIG. 4-*c* is a sectional view along the line III—III.

FIGS. 5-*a* and 5-*b* show opening and closing of the hook of the compound needle of the embodiment. FIG. 5-*a* shows the state of the hook that is open. FIG. 5-*b* shows the state at the time of transfer. The tongue of the slider is advanced beyond the hook.

FIGS. 6-*a* and 6-*b* show enlarged views of the head of the compound needle in the state of transfer. FIG. 6-*a* is a side view, and FIG. 6-*b* is a plan view.

FIGS. 8-*a* and 8-*b* show a modification of the compound needle. FIG. 8-*a* is a side view of the principal part of it, and FIG. 8-*b* is a plan view of the second slider part.

FIGS. 11-*a* and 11-*b* are partial enlarged side views of a third modification of the compound needle of which replacement can be done with ease. FIG. 11-*a* shows the state when the slider is advanced and the hook is closed. FIG. 11-*b* shows the state when the slider is retracted to the extreme position.

FIGS. 12-*a* and 12-*b* are partial enlarged side views of another modification of the compound needle, that can be replaced with ease. FIG. 12-*a* shows fitting of the top end of the jack into the hook member. FIG. 12-*b* shows the state when the slider is retracted to the extreme position.

FIGS. 13-*a* and 13-*b* show a modification of the compound needle of the embodiment. FIG. 13-*a* shows the state when a transfer jack is fit into the slider. FIG. 13-*b* is a plan view of the top end of the compound needle.

FIGS. 14-*a* and 14-*c* show a modification that relates to coupling between the slider and the needle proper. FIG. 14-*a* is a side view of the principal part of the compound needle. FIGS. 14-*b* and 14-*c* are sectional views along the line B—B and along the line C—C of FIG. 14-*a*, respectively.

FIGS. 15-*a* and 15-*b* show another modification that relates to coupling between the slider and the needle proper. FIG. 15-*a* is a side view of the principal part of the compound needle. FIG. 15-*b* is a sectional view along the line B—B of FIG. 15-*a*.

DETAILED DESCRIPTION OF THE PREFERRED EMBODIMENTS

An embodiment of the compound needle of the present invention will be described with reference to the attached drawings.

Figure 1:
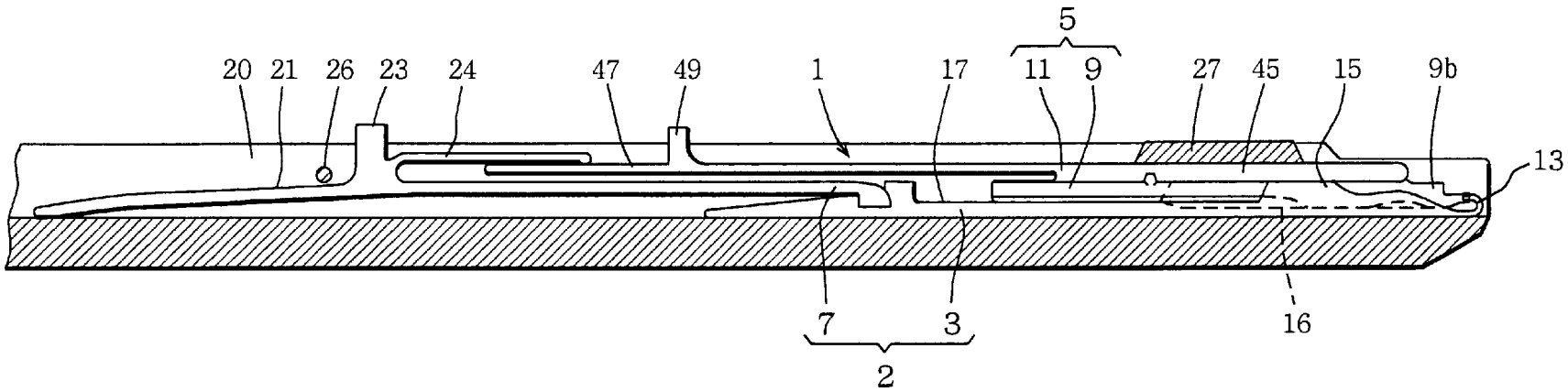
FIG. 1 is a side view of a compound needle of an embodiment and a jack that are contained in a needle groove of a needle bed.
Figure 2:
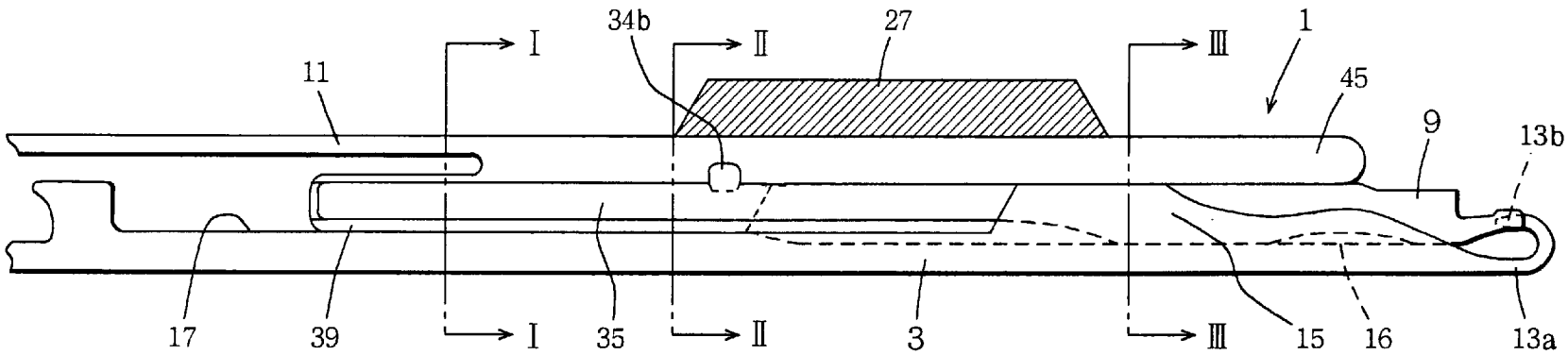
FIG. 2 is a partially magnified view of the compound needle of FIG. 1 that is taken out of the needle groove.
Figure 3:
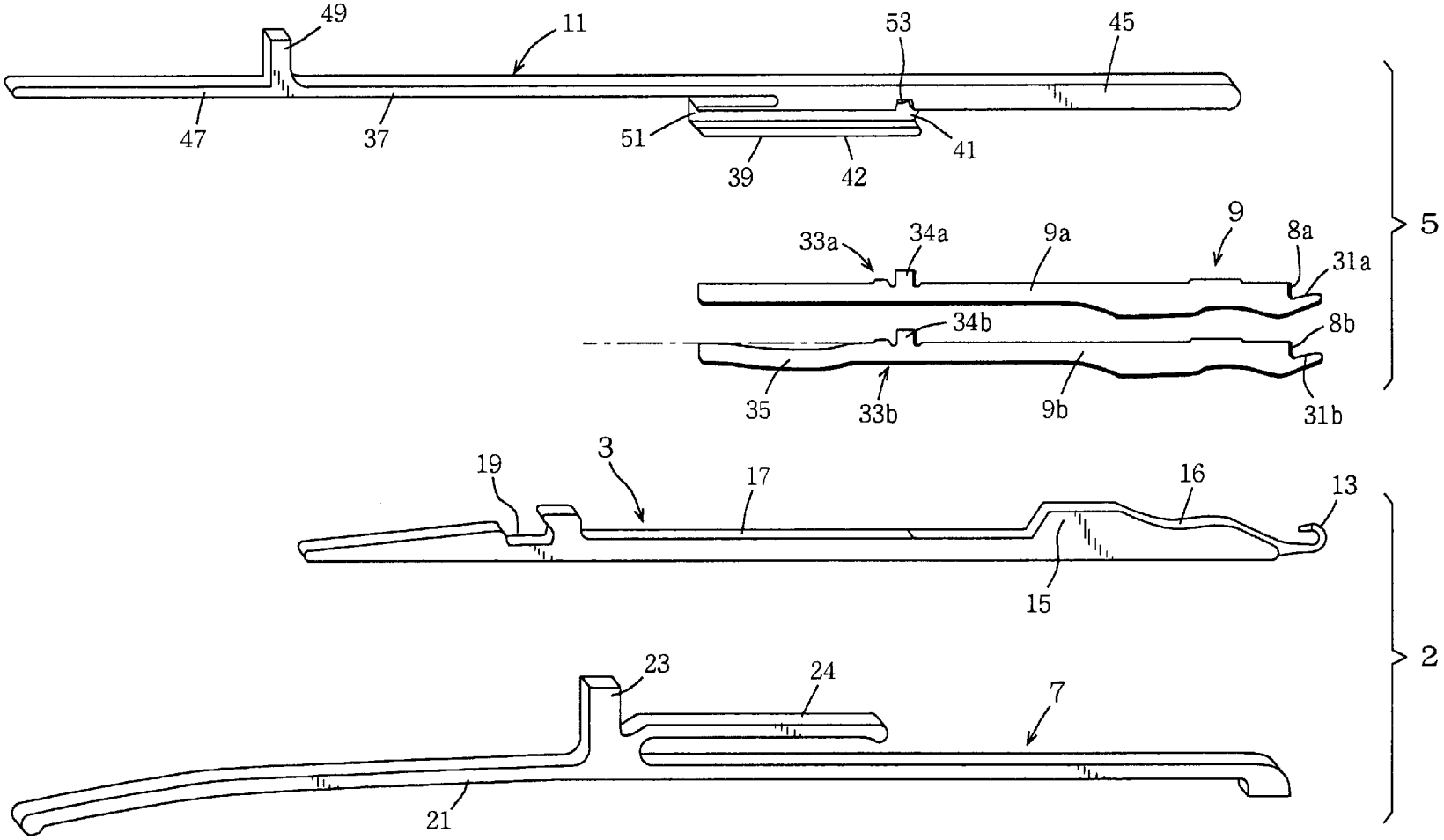
FIG. 3 is a perspective view showing various parts that constitute the compound needle.

The compound needle of the present embodiment is shown in FIG. 1 through FIG. 7. FIG. 1 is a sectional view of a needle bed showing the compound needle 1 inserted in a needle groove of the needle bed. FIG. 2 is an enlarged view of the front half of the compound needle 1 of FIG. 1. FIG. 3 shows various parts that constitute the compound needle 1. FIG. 4-*a* is a sectional view along the line I—I of FIG. 2. FIG. 4-*b* is a sectional view along the line II—II. FIG. 4-*c* is a sectional view along the line III—III. FIG. 5-*a* shows a hook 13 that is open. FIG. 5-*b* shows the state of transfer; a tongue 31 of a slider 5 is advanced beyond the hook 13. FIG. 6 is an enlarged view of the head of the compound needle at the time of transfer. FIG. 6-*a* is a side view, and FIG. 6-*b* is a plan view.

The compound needle 1 comprises a needle proper 2 and the slider 5. The slider 5 comprises a first slider part 9 and a second slider part 11.

In the present embodiment, the needle proper 2 comprises a hook member 3 being a first member, and a jack 7 being a separate second member. These members, however, may be formed integrally. In the present specification, the needle proper 2 is defined as a combination of the first member and the second member.

The hook member 3 is provided with, from the top end, a hook 13, a slider groove formation part 15 in which a slider groove 16 is formed to contain the first slider part 9, a needle proper center portion 17 that accepts an under arm 39 of the second slider part 11, that will be explained later, and forms a sliding support surface for the under arm 39, and in the rear a concave portion 19 for connecting the top end of the jack 7. The hook member 3 and the jack 7 are of the same thickness, and they are formed to be thinner than the width of the needle groove 20. The hook 13 is tapered from the hook base 13*a* toward the hook top 13*b*.

The jack 7 extends from the concave portion 19 of the hook member 3 toward the back of the needle bed, and has an elastic leg 21 that is curved so that a tail of the leg contacts the bottom of the needle groove. A control butt 23 is protrusively formed on the jack 7 near the needle proper center portion, and the jack 7 is supported by the elastic leg 21 so that the control butt 23 protrudes from the surface of the needle bed. Wire 26 is put through the needle bed longitudinally, and the elastic leg 21 is contained in the needle groove, being prestressed downward by the wire 26. The needle proper is provided with a sliding resistance in the needle groove by this prestress. A branch arm 24, branching from the jack proper and extending forward, is provided ahead of the control butt 23. The needle proper 2 is moved forward or backward in the longitudinal direction when a cam mounted on a cam carriage (not illustrated) is engaged with the control butt 23 and a forward or backward movement control is given to it. Or the control butt 23 is pressed by a presser cam to sink into the needle groove. As a result, the needle proper 2 is shifted to a rest position in which the needle proper 2 will not engage with the cam.

A metal plate 27 is mounted on the needle bed perpendicular to the advancing and retracting direction of the needle to prevent the needle proper 2 and the slider 5 from coming off the needle bed.

The first slider part 9 of the slider 5 comprises two thin plates 9*a*, 9*b* of roughly the same shapes, and is contained in a slider groove 16 formed in the hook member 3 of the needle proper 2. A tongue 31, that contacts the hook 13, is formed on the top end of the first slider part 9, and connections 33*a*, 33*b*, that connect with the second slider part 9, and a sliding-resistance-giving part 35, that will be explained later, are formed in the rear part that is not contained in the slider groove 15. Rear gaps 8*a* and 8*b* are provided on the tongues 31*a*, 31*b*. As for the upper edge of the tongue 31, the base is formed lower than the tip so that a loop held on the upper ridge of the tongue will not come off the tongue 31 inadvertently.

The second slider part 11 is formed, like the needle proper 2, to have a thickness a little thinner than the width of the needle groove. An under arm 39 is formed on the second slider part 11 at a point slightly ahead of the middle thereof in its longitudinal direction. The under arm 39 is branches from the second slider proper 37 to extend toward the needle main body center portion 17 formed in the hook member 3. A longitudinal groove 51 is formed by cutting on one side of the under arm 39, and a recess 53 is bored above the longitudinal groove and between the second slider main body 37 and the under arm 39. In the under arm 39, a connection 41 is formed for receiving the rear end of the first slider part 9 and a sliding contact surface 42 that is beneath the connection 41, extends backward to enable the second slider part 11 to slide over the upper edge of the needle proper center portion 17 of the hook member 3. The longitudinal groove 51 is made deeper than the total thickness of the two thin plates 9*a*, 9*b*.

Ahead of the second slider main body 37, is formed a head 45 that extends forward above and in parallel with the first slider part 9. This head 45 contacts the slider groove formation part 15 of the needle proper 2 to support the slider 5 on the needle proper and to provide a support, that will be described later, to the second slider part 11 as well.

Figure 7:
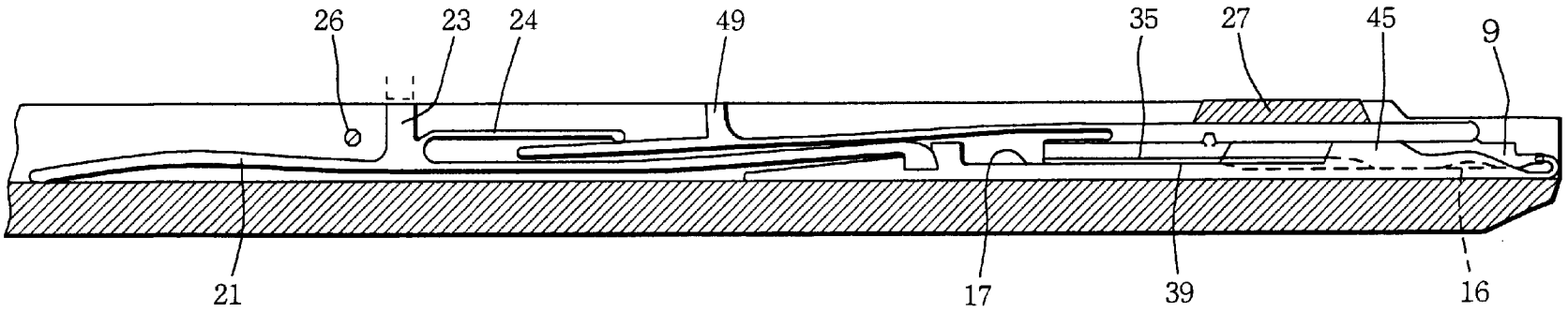
FIG. 7 shows the state of the compound needle of the embodiment when the control butt is pressed by a presser and sunk into the needle groove.

The second slider part 11 is provided with a rear part 47 of which a tail end extends beyond the needle proper center portion 17 and enters in a space between the body proper of the jack 7 and the branched arm 24. This rear part 47 is formed thinner in thickness in the direction of height relative to the head 45, and is elastic. A control butt 49 of the slider is protrusively formed on the upper edge of the rear part 47, and when the control butt 49 of the slider engages with a cam mounted on the cam carriage and is subjected to advancing or retracting control, the slider 5 will be advanced to or retracted from the trick gap. Or when the control butt 23 of the jack 7 is sunk into the needle groove, the rear part 47 is pressed by the branch arm 24 and the control butt 49 of the slider is sunk into a rest position in which it will not engage with the cam. FIG. 7 shows the state when the control butt 23 of the jack 7 is pressed by the presser.

The first slider part 9 is coupled with and fixed to the second slider part by positioning the protrusion 34 in the recess 53 of the second slider part, containing the tail in the longitudinal groove 51, and caulking the side walls of the recess 53 of the second slider part 11 that surround the protrusion 34, and the side walls of the longitudinal groove 51. At the time of this coupling, the lower edge of the head 45 of the second slider part 11 is used as the reference plane. If the upper edge of the first slider part 9 is placed on this plane, the first slider part 9 can be fixed without any sway of its top end. The tail of one thin plate 9*b* of the first slider part 9 extending into the longitudinal groove 51 is curved so that it contacts the side wall of the needle groove due to the spring pressure; thus, a sliding-resistance-giving-part 35 is formed. With this arrangement, when the needle proper 2 is moved forward or backward, the slider 5 is prevented from being moved inadvertently by the movement of the needle proper 2. This sliding-resistance-giving part 35 is formed ahead of the control butt 49 of the slider to minimize its adverse effects on the rising and sinking of the control butt 49 of the slider, and preferably, the sliding-resistance-giving part 35 is made in a portion in which the sliding-resistance-giving part 35 will not undergo any elastic deformation when the control butt of the slider is subjected to raising or sinking.

With regard to giving sliding resistance to the slider, in place of the above-mentioned method, the resistance may be given by, for example, forming the rear of the longitudinal groove of the under arm as an opening and bending each of the thin plates 9*a*, 9*b* constituting the first slider part so that each is pressed to contact the opposing side wall of the needle groove, or forming longitudinal grooves on both sides of the under arm, inserting the thin plates 9*a*, 9*b* constituting the first slider part in the longitudinal grooves, one thin plate in each groove, and bending the rear of each first slider plate toward the needle wall.

In the following, the actions of the compound needle 1 that is configurated as described above will be described.

The compound needle 1, comprising the needle proper 2 and the slider 5, is contained in the needle groove, with the lower edge of the slider 5 (the head 45 and the under arm 39 of the second slider part 11) contacting the upper edge of the corresponding needle proper 2 (the slider groove formation part 15 and the needle proper center portion 17 of the hook member 3). The top of the slider 5 is regulated by the metal plate 27 to prevent the compound needle 1 from lifting and coming out of the needle groove. As various parts of the slider 5 and the needle proper 2 contact with each other to regulate their respective positions in the vertical direction inside the needle groove, the needle proper 2 and the slider 5 are securely supported, as one body, in the needle groove. At the time of knitting, the above-mentioned contact surfaces provided on the needle proper 2 and the slider 5 work, in relation with the first slider part 9, as follows. In case of transfer as shown in FIG. 6, the contacting surfaces allow the tongue 31 of the first slider part 9 to advance beyond the hook 13. As a result a stitch loop 57 on the tongue 31 is pushed over the trick gap. Under this condition, when a hook 60 of a needle (receiving needle) of the opposing needle bed is put through this stitch loop 57, the receiving needle will work to lift the tongue 31. However, as the first slider part 9 is prevented, by the head 45 of the second slider part 11, from being lifted up, transfer will be made reliably. As described before, in the compound needle 1 of the present embodiment, the hook 13 is tapered (FIG. 6-*b*), when the tip of the tongue 31 of the first slider part 9 advances beyond the hook 13, the tongues 31*a*, 31*b* will be pushed apart by the tapered form of the hook 13, making it easy for the receiving needle 60 to enter into the space between these tongues 31*a*, 31*b*.

As shown in FIG. 7, when the control butt 49 of the slider 5 is sunk into the needle groove, a force will act to lift the tip of the slider with the under arm 39 serving as a fulcrum. However, this upward force is countered by the action between the head 45 of the second slider part 11 and the metal plate 27. Hence no direct load is exerted to the first slider part 9.

FIGS. 8-*a* and 8-*b* show a first modification of the compound needle of the present invention. It should be noted that, in each modification, similar reference numerals to those of the embodiment of FIG. 1 through FIG. 7 denote similar parts, and any parts that are not specifically explained are similar to those of the embodiment of FIG. 1 through FIG. 7. FIG. 8-*a* is a side view of the compound needle, and FIG. 8-*b* is a plan view of the second slider part. In this compound needle 101, the lower edge 142 of an under arm 139 formed on the second slider 111 and the upper edge of a needle proper center 117 formed in the hook member 103 are arranged to have a gap h between them when no load is applied or no pressure is applied from above. Thus only the upper edge of a slider groove formation part 115 formed on the hook member 103 serves as the sliding support surface for the slider 105 that moves relative to the needle proper 2. When the control butt (not illustrated) of the slider 105 is pressed to sink into the needle groove, the under arm 139 is also lowered due to the elastic deformation of the second slider main body 137. As a result, the lower edge 142 of the under arm 139 contacts the upper edge of the needle proper center portion 117 to absorb any sway of the slider 105. The subsequent steps are similar to those of the above-mentioned embodiment, and the force that lifts the tip side of the slider is countered by the action between the head 145 of the second slider part 111 and a metal plate 127 to prevent any direct load from being exerted to the first slider 109. It should be noted that in this compound needle 101 a spring-type sliding-resistance-giving part 135 is formed in the second slider part 111. In the example illustrated in the diagram, the sliding-resistance-giving part 135 is formed ahead of the under arm 139 of the second slider main body 137. And as shown in FIG. 8-*b*, one side of the second slider part 111 is cut away and that part is bent to form the sliding-resistance-giving part 135, and the side of the slider is pressed to contact the side wall of the needle groove. The sliding-resistance-giving part 135 may be formed in the under arm 139 of the second slider part. In either case, a greater sliding resistance can be given in comparison with the case when the sliding-resistance-giving part is formed in the first slider, like the embodiment. As a result, when the needle proper is moved forward or backward, the slider 105 is more reliably prevented from being moved inadvertently together with the needle proper. Naturally, sliding-resistance-giving parts may be formed in both the first slider and the second slider part.

Figure 9:
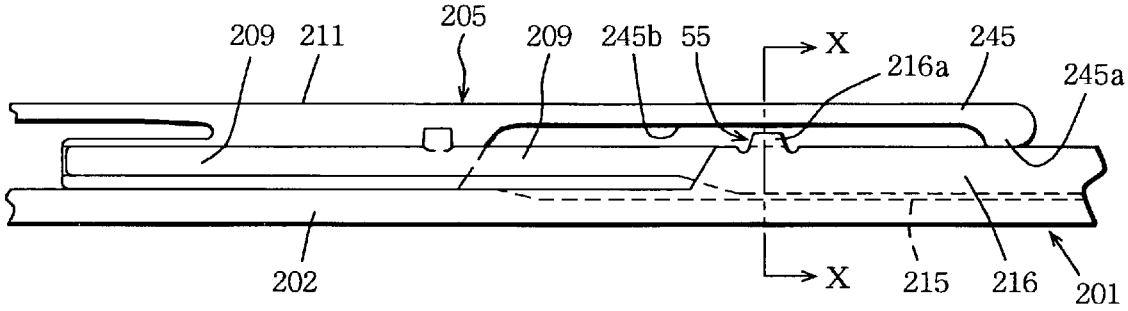
FIG. 9 shows a second modification and is an enlarged view of a stopper for the first slider part, that is provided on the needle proper.
Figure 10:
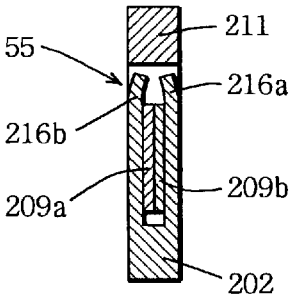
FIG. 10 is a sectional view along the line X—X of FIG. 9.

FIGS. 9 and 10 show a second modification of the compound needle of the present invention.

FIG. 9 is a partial enlarged view of a compound needle 201 wherein a slider groove formation part 216 of a needle proper 202 is provided with a stopper 55 of the first slider part 209, and FIG. 10 is a sectional view along the line X—X of FIG. 9. This is a case where the slider 205 is prevented from easily coming off the needle proper when the needle is handled for replacement, etc. In this case, some portions of the slider groove formation part 216 are made to protrude, and these protrusions 216*a*, 216*b* are bent inward to serve as stoppers 55 of the slider. As a result of this arrangement, the lower edge 245*a* of the tip of the head 245 of the second slider part 211 contacts the upper edge of the slider groove formation part 216, and the lower edge 245*b* behind the tip is formed as a recess. This recess is formed over the stroke of the relative movement of the needle proper 202 and the slider 205. With this arrangement, due to the recess, the forward and backward movements of the needle proper 202 are not hindered, and no precision bending is required for the stoppers 55 of the slider, and the above-mentioned second slider part 211 exhibits its function as a guide, and once the first slider part 209 is contained in the slider groove 215, the first slider part 209 is prevented by the stoppers 55 from coming off upward.

FIGS. 11-*a* and 11-*b* show a third modification of the compound needle of the present invention. This modification is an improvement of the compound needle described above for easier needle replacement.

FIG. 11-*a* is a partial enlarged view of the state of a hook member 303, a slider 305 and a jack 307 when the hook is closed. FIG. 11-*b* is a partial enlarged view of the state of the hook member 303, the slider 305 and the jack 307 when the slider 305 is retracted to the extreme position.

In this compound needle 301, a sliding-resistance-giving part 335 is bent outward to press against the side wall of the needle groove and is formed in the rear end of one thin plate 309*b* of the first slider part 309 that extends into a longitudinal groove 351 of an under arm 339 formed on the second slider part 311. In FIG. 11-*b*, the line on the right of the sliding-resistance-giving part 335 is the line of the curved portion. A protrusion 360, that extends backward, is formed on the upper rear end of one thin plate 309*a* of the first slider 309. The protrusion 360 may be formed on either one of the thin plates 309*a*, 309*b* forming the first slider part 309, or protrusions 360 may be formed on both of the thin plates 309*a*, 309*b*. The protrusion 360 may be formed on the second slider part 311.

A concave portion 319 for receiving the tip of the jack 307 is formed behind the needle proper center portion 317 of the hook member 303 by cutting away the upper portion of the hook member 303. As a result of the formation of the concave portion 319, a protruding part 361 is formed on the upper edge of the hook member 303 between the recessed needle proper center portion 317 and the concave portion 319. A groove 362 is formed in the top of the protruding part 361 in the longitudinal direction thereof, and a groove 363 is formed, in the longitudinal direction thereof, in the top of the tip of the jack 307 that fits in the concave portion 319.

When the slider 305 is retracted to the extreme position, the protrusion 360, which is formed backward on the upper rear end of the thin plate 309*a*, goes through the groove 362 formed in the protruding part 361 formed on the upper edge of the hook member 303, and also fits in the groove 363 formed in the top of the tip of the jack 307, that fits into the concave portion 319.

With this arrangement, the hook member 303, the slider 305 and the jack 307 are united by the protrusion 360 formed on the first slider part 309, and they are prevented from coming off sideways.

To prevent the protrusion 360 formed on the first slider part from coming out of the groove 362 formed in the top of the tip of the jack 307 or groove 363 formed in the protruding part 361 on the upper edge of the hook member 303, due to rising of the slider 305 when the slider 305 is retracted to the extreme position, an engagement slope 364 is formed, by cutting, on the top of the rear end of the under arm 339 of the second slider part 311 that contacts the protruding part 361 on the upper edge of the hook member 303. A notch 365 is formed on the front end of the protruding part 361 so that the notch 365 can engage with the engagement slope 364 formed on the back end of the under arm 339 of the second slider part 311.

With this arrangement, when the slider 305 is retracted to the extreme position, the protruding part 361 on the upper edge of the hook member 303 and the back end of the under arm 339 of the second slider part 311 engage with each other to eliminate any lifting of the slider 305, further stabilizing the integration of the hook member 303, the slider 305 and the jack 307 by the protrusion 360 formed on the first slider 309. The engagement slope 364 formed on the back end of the under arm 339 of the second slider part 311 may be formed by protruding the lower part of the back end of the under arm 339. And as for the protruding part 361 on the upper edge of the hook member 303, that engages with the engagement slope 364, the upper part of the protruding part 361 may be protruded forward instead of forming the notch.

In replacing a compound needle of this kind, if the compound needle does not have the function of uniting the hook member 303, the slider 305 and the jack 307 such as the one described above, when it is taken out of the needle groove of the needle bed, coupling of the members will be undone and the compound needle will break into pieces. It is not easy to replace such a compound needle.

In particular, it is much more difficult to replace a compound needle on a flat knitting machine of a type wherein upper needles, transfer jacks, sinkers, etc. are supported, as upper knitting members, over a pair of front and back needle beds facing each other.

In the compound needle 301 of the present modification, needle replacement is made when the slider 305 is retracted to the extreme position. Under this condition, the protrusion 360 that is formed on the first slider part 309 unites the hook member 303, the slider 305 and the jack 307. Hence needle replacement can be made with ease.

FIGS. 12-*a* and 12-*b* show a fourth modification of the compound needle of the present invention. This is a modification of the compound needle that allows easy replacement of the needle.

FIG. 12-*a* is a partial enlarged view of a hook member 403 and a jack 407 and a slider 405 when the tip of the jack 407 is fit in a concave portion 419 in the hook member 403. FIG. 12-*b* is a partial enlarged view of the hook 403, the slider 405 and the jack 407 when the slider 405 is retracted to the extreme position.

In the third modification described above, needle replacement work is made easier by arranging that when the slider 305 is retracted to the extreme position the protrusion 360 that is formed on a thin plate 309*a* of the first slider part unites the hook member 303, the slider 305 and the jack 307.

In the compound needle 401 of the fourth modification, like the compound needle 301 described above, a groove 462 is formed, in the longitudinal direction, in the top of a protruding part 461 that is formed on the upper edge of the hook member 403, and a protrusion 460, that extends backward, is formed on the upper rear end of at least one of the two thin plates 409*a*, 409*b* that constitute the first slider part 409. When the slider 405 is retracted to the extreme position, the protrusion 460 fits in the groove 462 that is formed in the protruding part 461 on the upper edge of the hook member 403. The length of the protrusion 460 is such that the protrusion 460 does not protrude from the rear end of the protruding part 461 of the hook member 403.

The tip of the jack 407 is fitted into a concave portion that is formed behind the needle proper center portion 417 of the hook member 403. A protrusion 463 that protrudes forward is provided on the upper part of the tip of the jack 407. The protrusion 463 is formed to be a little thinner than the width of the groove 462 that is formed in the protruding part 461 on the upper edge of the hook member 403.

To fit the tip of the jack 407 into the concave portion 419 that is formed in the hook member 403, as shown in FIG. 12-*a*, with the leg of the jack 407 being tilted downward, the tip of the jack 407 is fit into the concave portion 419 sideways. In this way, the protrusion 463 that is provided on the upper part of the tip of the jack 407 is prevented from contacting the side wall of the protruding part 461 of the hook member 403, and the tip of the jack 407 can be successfully fit into the concave portion 419.

Needle replacement is made, as shown in FIG. 12-*b*, with the leg of the jack 407 being raised upward. As a result, the protrusion 463 that is provided on the tip of the jack 407 fits into the groove 462 that is formed in the protruding part 461 of the hook member 403. As the jack 407 and the hook member 403 are united, no part will come off sideways.

At the time of needle replacement, the slider 405 is retracted to the extreme position. Hence the protrusion 460 that is formed on the first slider part 409 unites the slider 405 and the hook 403, and no part will come off sideways.

Accordingly, to insert the needle in the needle groove of the needle bed, the slider 405 is retracted to the extreme position, and the leg of the jack 407 is lightly pushed down from above. In this way the needle replacement can be done with ease.

Provision of the protrusion 463 on the tip of the jack 407 has a merit that it is easier to work rather than forming a groove in the top of the tip of the jack 407.

Although not illustrated, a groove may be formed in the longitudinal direction in the lower part of the tip that is formed on the second slider part. Then protrusions that are formed on the upper parts of the two thin plates of the first slider part or a protrusion on one of the thin plates are inserted into this groove to provide a support. In this way, the sideways movement of the slider can be restrained, and needle replacement is made much more easy.

FIGS. 13-*a* and 13-*b* show a modification wherein insertion of a transfer jack 504 into a slider is made easier. Expanded parts 500*a*, 500*b* are made in the thin plates 9*a*, 9*b* of the first slider part 9 behind a tongue 31 (behind the gaps 8*a*, 8*b*). These parts are expanded sideways to form an opening. Thus insertion of a transfer jack 504 from above is made easier. A bending line 502 for the expanded parts 500*a*, 500*b* is shown. The use of a transfer jack on a flat knitting machine is known publicly.

FIGS. 14-*a*, -*b* and -*c* show a fifth modification wherein slidable coupling between the slider and the needle proper is strengthened. In FIGS. 14-*a, b* and -*c*, the second slider part is 510, and the hook member is 512. A slider groove formation part 514 is provided on the hook member 512 along the bottom of a head 45 of the second slider part 510. At bends 516, both walls of the slider groove formation part 514 are bent inward to prevent the first slider part 9 from coming off upward and swaying. A guide groove 518 that directly connects with a slider groove 16 is provided, and a protrusion 520 formed on an under arm 39 of the second slider part 510 is made to slide in the guide groove 518 to prevent the slider from coming off sideways. The first slider part 9 is caulked in the second slider part 510 at the protrusions 34 and caulking parts 522. Thus they are united into one body. A protrusion 524 of the hook member 512 and a fitting 526 comprising the tails of the under arm 39 and the second slider part 510 are engaged when the slider is retracted. This prevents the slider and the needle proper from separating from each other when, for example, the needle is replaced.

The first slider part 9 and the second slider part 510 are caulked at two points to be united into one body. The first slider part 9 is prevented from coming off the slider groove 16 by the bends 516, and the protrusion 520 is guided in the guide groove 518. Before setting the compound needle in the needle bed, if the fitting 526 is engaged with the protrusion 524, this part also prevents the slider from coming off the hook member 512 upward. Thus the needle proper and the slider can be handled as one body.

Instead of the modification of FIG. 14, a protrusion 530 may be provided on the first slider part 9 as shown in FIGS. 15-*a* and 15-*b*. An opening 532 of an under arm 39 can be provided for allowing the protrusion 530 to come into the guide groove 518.

Suitable embodiments of the compound needle were described above. The present invention, however, is not limited to these embodiments, and can be practiced in various ways within the technical scope of the present invention.

I claim:

1. A compound needle for a flat knitting machine to be contained in a needle groove formed in a needle bed of the flat knitting machine, the compound needle comprising a needle proper having a hook at a top end thereof and a slider, wherein the needle proper and the slider are movable relative to each other in such a manner that a tongue provided on a top end of the slider opens and closes the hook, and the tongue is movable beyond the hook, and wherein:

said slider comprises a first slider and a second slider part, adjacent the hook formed at the top end of said needle proper, the needle proper is provided with a slider groove formation part defining a slider groove to contain said first slider part, the slider groove formation part having an upper edge contacting said second slider part;

a needle proper center portion is formed adjacent the slider groove formation part by indenting an upper part of the needle proper;

a control butt is provided on the upper edge of the needle proper extending backward from the needle proper center portion, and an elastic needle proper rear leg, that allows said control butt to sink into the needle groove, is formed in the needle proper;

the first slider part comprises two thin plates that are contained in the slider groove formed in said needle proper, a top end of each of the thin plates defines and forms a tongue, and a rear of the first slider part is exposed above said needle proper center portion;

the second slider is formed to have a thickness substantially equal to a thickness of said needle proper;

the second slider is provided with;

a head part extending forward above the first slider part and having a lower edge contacting the upper edge of said slider groove formation part, and said head part supporting the upper edge of the first slider part;

an elastic slider rear part extending backward beyond said needle proper center portion has a slider control butt at an upper edge, and allows said slider control butt to sink into the needle groove, and an under arm between said elastic slider rear part and said head part extends over said needle proper center portion to connect the exposed portion of said first slider part; and a sliding-resistance-giving part that makes said slider slide against the needle groove to use that sliding resistance is formed on said slider.

2. The compound needle for a flat knitting machine of claim 1 wherein said sliding-resistance-giving part is formed ahead of the slider control butt.

3. The compound needle for a flat knitting machine of claim 1 wherein the lower edge of said under arm contacts the upper edge of said needle proper center portion so that said slider is supported by the needle proper center portion.

4. The compound needle for a flat knitting machine of claim 1 wherein at the back of the tongues said two thin plates are expanded to both sides to form an opening.

5. The compound needle for a flat knitting machine of claim 1 wherein a guide groove is made in said needle proper center portion opposite said under arm.

6. The compound needle for a flat knitting machine of claim 5 wherein said slider is provided with a protrusion at the position of said under arm, and said protrusion is contained in said guide groove.

7. The compound needle for a flat knitting machine of claim 1 wherein the upper parts of said slider groove formation part are at least partially bent inward to prevent the first slider part from coming out of the slider groove.

8. The compound needle for a flat knitting machine of claim 1 wherein in the rear of said under arm, said slider, and a protrusion provided on said needle proper are engaged.

* * * * *